US006896648B2

(12) United States Patent
Fujinuma

(10) Patent No.: US 6,896,648 B2
(45) Date of Patent: May 24, 2005

(54) ADJUSTABLE-TIMING JAW CYLINDER APPARATUS AT THE FOLDING STATION OF A WEB-FED PRINTING PRESS

(75) Inventor: Hiroyuki Fujinuma, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/318,120

(22) Filed: Dec. 13, 2002

(65) Prior Publication Data

US 2003/0130103 A1 Jul. 10, 2003

(30) Foreign Application Priority Data

Jan. 18, 2002 (JP) ..... 2002-010227

(51) Int. Cl.[7] ..... B31F 1/08

(52) U.S. Cl. ..... 493/426; 493/424; 493/434; 493/442

(58) Field of Search ..... 493/424, 425, 493/426, 442, 476, 434

(56) References Cited

U.S. PATENT DOCUMENTS

| | | | | |
|---|---|---|---|---|
| 2,381,094 A | | 8/1945 | Worthington | |
| 5,503,071 A | * | 4/1996 | Hillebrand et al. | 101/409 |
| 6,283,906 B1 | * | 9/2001 | Kostiza | 493/424 |
| 6,358,192 B1 | * | 3/2002 | Michalik | 493/424 |
| 6,514,188 B2 | * | 2/2003 | Kostiza | 493/424 |

FOREIGN PATENT DOCUMENTS

| | | | |
|---|---|---|---|
| DE | 1132564 B1 | | 7/1962 |
| DE | 19530956 A1 | | 5/1996 |
| DE | 2549761 B1 | | 2/1997 |
| JP | 04-022463 A1 | | 2/1992 |
| JP | 05-026949 A1 | | 4/1993 |
| JP | 3038212 B | * | 2/2000 |
| JP | 2001-026374 | | 1/2001 |

OTHER PUBLICATIONS

European Search Report dated Nov. 20, 2003.

* cited by examiner

*Primary Examiner*—Rinaldi I. Rada
*Assistant Examiner*—Christopher Harmon
(74) *Attorney, Agent, or Firm*—Rader, Fishman & Grauer PLLC

(57) ABSTRACT

A jaw cylinder has sets of fixed and movable jaws arranged at circumferential spacings thereon for folding the printed sheets into signatures as the sheets are thrust into the jaw cavities by folding blades on a folding cylinder. The movable jaws are mounted fast on respective jaw carrier shafts for pivotal motion into and out of engagement with the fixed jaws. For such pivotal motion of the movable jaws, the jaw carrier shafts are engaged via cam followers with a jaw drive cam of annular shape mounted to the frame, so that the movable jaws successively pivot toward and away from the fixed jaws upon rotation of the jaw cylinder. A timing screw acts between the jaw drive cam and the frame to cause angular displacement of the former relative to the latter about the axis of the jaw cylinder, in order to time the opening and closing of all the sets of jaws to the thrusting of the sheets off the surface of the folding cylinder by the folding blades.

7 Claims, 4 Drawing Sheets

ADJUSTABLE-TIMING JAW CYLINDER APPARATUS AT THE FOLDING STATION OF A WEB-FED PRINTING PRESS

BACKGROUND OF THE INVENTION

1. Field of the Invention

This invention relates to a jaw cylinder which typically lends itself to use at the folding station of a rotary printing press for folding successive sheets of printed paper into signatures. More particularly, the invention deals with such a jaw cylinder having two or more sets of fixed and movable jaws arranged at circumferential spacings thereon for folding the printed sheets as they are thrust into the jaw cavities by folding blades on a folding cylinder which also is included in the folding mechanism. Still more particularly, the invention is directed to how to open and close the set or sets of jaws on the jaw cylinder in timed relationship to the thrusting of the successive sheets off the surface of the folding cylinder by the folding blades.

2. Description of the Prior Art

The folding mechanism for a web-fed printing press usually comprises a cutting cylinder in addition to the noted folding cylinder and jaw cylinder. The printed web of paper is first wrapped around part of the folding cylinder which is in constant rotation in the course of printing and, while being done so, cut into successive sheets by cutting blades on the cutting cylinder which is held against the folding cylinder via the web. The folding cylinder is equipped with elongate folding blades arranged at circumferential spacings thereon and each extending parallel to the axis of the folding cylinder. Each folding blade is movable radially of the folding cylinder.

Pushed in part off the surface of the folding cylinder by one of the folding blades, the sheet together with the folding blade is inserted in one of the jaw cavities formed in the surface of the jaw cylinder at circumferential spacings, the jaw cylinder being in rolling engagement with the folding cylinder. The sheet thus pushed into the jaw cavity is therein engaged between the fixed and the movable jaws as the movable jaw is closed against the fixed jaw, and thereby folded in the middle. The thus folded sheet is subsequently carried away from the surface of the folding cylinder by the jaw cylinder.

It is therefore apparent that each movable jaw on the jaw cylinder must be closed against the fixed jaw to grip the sheet therebetween in split-second precision timing to the thrusting of this sheet into the cavity between the jaws by one associated folding blade on the folding cylinder. Should this timing be improper, the sheets would not be captured by the jaws but might be ruined or smeared by rubbing against the folding blades or the jaws, resulting in a drop in the rate of production or in the quality of the printings. The folding blades and the jaws might also go out of order and wear out prematurely.

For pivotal motion into and out of sheet-folding engagement with the fixed jaw, the movable jaw is mounted to a jaw carrier shaft which in turn is mounted to the jaw cylinder in parallel spaced relationship to the jaw cylinder axis. The jaw carrier shaft has cam follower means on one end thereof for engagement with a jaw drive cam of annular or disklike shape on the frame means. As the jaw cylinder rotates, the jaw carrier shaft revolves with the cam follower means in constant engagement with the jaw drive cam, thereby to be rotated bidirectionally about its own axis and hence to cause the movable jaw to pivot into and out of sheet-folding engagement with the fixed jaw.

Thus the jaw drive cam must be in exact angular position relative to the jaw cylinder in order to cause the pivotal motion of the movable jaw in proper timing to the thrusting motion of the associated folding blade on the folding cylinder. Furthermore, even if the jaw drive cam is initially correctly positioned relative to the jaw cylinder, readjustment may become necessary in course of time because of change in the timing as a result of the wear of the jaws and the folding blades.

The concept of making the jaws of the jaw cylinder adjustable in timing to the folding blades on the folding cylinder is itself not new in the art. Japanese Unexamined Utility Model Publication Nos. 4-22463 and 5-26949 are hereby cited as teaching jaw cylinders complete with timing mechanisms for the jaws.

The jaw cylinder according to the first cited reference has two sets of fixed and movable jaws in circumferentially spaced positions thereon. The movable jaws of the two jaw sets are pivotally mounted one to each of two jaw carrier shafts which in turn are rotatably mounted to the jaw cylinder in diametrically opposite positions thereon and which extend parallel to the jaw cylinder axis. These two jaw carrier shafts have cam follower means each on one end thereof for constant engagement respectively with the peripheries of two jaw drive cams of annular or disklike shape mounted to the frame means. The two jaw drive cams are displaced from each other axially of the jaw cylinder. One of them is angularly displaceable relative to the frame means about the axis of the jaw cylinder. The angular position of this one cam is adjustably variable from outside the frame means by turning a drive pinion in mesh with a driven gear rotatable with that cam, in order to adjust the opening and closing of one associated set of jaws to the thrusting motion of one associated folding blade on the folding cylinder.

The second mentioned reference, Japanese Unexamined Utility Model Publication No. 5-26949, suggests a jaw cylinder that is similar to that of the first citation in having two sets of fixed and movable jaws, with the movable jaw of each set pivotally mounted on one of two jaw carrier shafts. These jaw carrier shafts have cam follower means in constant engagement respectively with the peripheries of two jaw drive cams mounted to the pair of confronting framing walls between which is supported the jaw cylinder. Here again, only one of the jaw drive cams is angularly displaceable about the jaw cylinder axis by gear drive similar to that of the first described prior art.

Thus the two Japanese utility model applications cited above are alike in that only one of the two sets of jaws is readjustable by varying the angular position of one associated jaw drive cam. The other, non-readjustable jaw drive cam must be mounted in an angular position that has been determined as a result of careful observation of how the opening and closing of the set of jaws is timed to the thrusting motion of one associated folding blade on the folding cylinder. Skilled labor as well as an expenditure of unjustifiably long time has therefore been required for mounting the non-readjustable jaw drive cam at the time of assemblage, maintenance, and repair, adding substantively to the installation and running cost of the printing press. What is more, not even the slightest readjustment has been possible during the progress of printing, without setting the complete machinery out of operation.

The gear drive employed by both prior art devices for readjustment of one set of jaws is itself objectionable. The need arises in practice for turning the jaw drive cam through as small an angle as, say, a tenth degree for precisely timing the jaws to the folding blade. An inordinately fine turn of the drive pinion is required for turning the jaw drive cam through such a small angle. Aggravating the difficulty of such fine readjustment is the backlash inherent in the gearing, which is too great compared to the required angle of turn of the drive pinion. Such readjustment has indeed been possible only by highly skilled personnel, and that with trials and errors.

SUMMARY OF THE INVENTION

The present invention has it as an object to make any desired number of sets of jaws on a jaw cylinder conjointly adjustable in timing to the folding blades on a folding cylinder irrespective of whether the machine is in or out of operation.

Another object of the invention is to enable even un- or semi-skilled personnel to make fine readjustment of the timing.

Still another object of the invention is to expedite the assemblage of the jaw cylinder apparatus incorporating the timing means according to the invention.

Briefly, the present invention concerns, in a folding mechanism which typically is to be applied to a rotary printing press for folding printed sheets, an adjustable-timing jaw cylinder apparatus comprising a jaw cylinder mounted to frame means for rotation with its own axis. A plurality of movable jaws are mounted fast to respective jaw carrier shafts which in turn are mounted to the jaw cylinder at circumferential spaces for bidirectional rotation about their own axes extending parallel to the jaw cylinder axis. Thus, upon bidirectional rotation of the jaw carrier shafts relative to the jaw cylinder, the movable jaws are pivotable into and out of engagement with fixed jaws on the jaw cylinder.

For such pivotal motion of the movable jaws there is provided a jaw drive cam of annular shape which is mounted to the frame means so as to be capable of angular displacement relative to the same about the axis of the jaw cylinder and of being retained in fixed relationship to the frame means in a desired angular position relative to the jaw cylinder. All the jaw carrier shafts are coupled respectively to jaw drive cam follower means which are operatively engaged with the jaw drive cam for causing the movable jaws to pivot successively into and out of engagement with the respective fixed jaws upon rotation of the jaw cylinder.

Also included are timing means acting between the frame means and the jaw drive cam for adjustably varying the angular position of the latter relative to the former. A change in the angular position of the jaw drive cam on the frame means is tantamount to a change in phase relationship between the jaw drive cam and the jaw sets on the jaw cylinder, and hence to a change in the time relationship between the pivotal motion of the movable jaws and the thrusting motion of the successive printed sheets off the surface of the folding cylinder.

It is to be noted that all the jaw carrier shafts are driven as their cam follower means travel in engagement with one and the same jaw drive cam. All the movable jaws are therefore finely readjustable in timing by the timing means either when the printing press is in or out of operation. No skilled labor, or no expenditure of any such prolonged periods of time as have been required heretofore, is needed for the assemblage of the jaw cylinder apparatus and for the adjustment and readjustment of the timing. Printed sheets will be folded correctly for a greatly extended length of time than has been possible conventionally.

In a preferred embodiment the timing means take the form of a lead screw coupled to and acting between the frame means and the jaw drive cam. The lead screw is to be turned manually to vary the angular position of the jaw drive cam on the frame means. The lead screw is preferable to conventional gear drive for the fine incremental travel of the jaw drive cam attainable. The backlash of the lead screw is materially less than that of gear drive, hardly affecting the fine positioning of the jaw drive cam. Although the lead screw provides linear motion, rather than rotation, for the required angular displacement of the jaw drive cam, this presents no inconvenience at all because the jaw drive cam need not be turned through any angle beyond the capabilities of the lead screw for readjustment of the timing according to the invention.

The present invention further features the specific construction of the jaw drive cam follower means through which each jaw carrier shaft is engaged with the jaw drive cam. The cam follower means include a crank arm which is proximally mounted fast to each jaw carrier shaft and which has a crankpin extending from its distal end. A pair of cam follower rollers are rotatably mounted side by side on this crankpin for rolling engagement respectively with a pair of annular, concentric cam surfaces of the jaw drive cam which are spaced from each other both radially and axially of the jaw drive cam.

Thus the pair of cam follower rollers on the crankpin is constrained by the pair of concentric cam surfaces to trace the contour of the jaw drive cam, for more positive swinging of the movable jaw into and out of engagement with the fixed jaw, without the risk of mishandling, smearing or otherwise damaging the printed sheets. Furthermore, each being in rolling contact with one cam surface only, the pair of cam follower rollers are capable of smoothly rolling over the cam surfaces with a minimum of abrasion.

According to a further feature of the invention, the crankpin of each jaw drive cam follower means is offset and coupled to the crank arm for rotation about an axis that is in parallel spaced relationship to the axis of the pair of cam follower rollers. A set screw or the like is provided for locking the crankpin to the crank arm against rotation in a desired angular position thereon. Such offset crankpins make it possible to assemble the jaw cylinder apparatus in the face of some dimensional errors that must be tolerated in the manufacture of the jaw drive cam and the cam follower means.

Still another feature of the invention is that, having to be installed at a narrowly confined space between one end of the jaw cylinder and one of the pair of confronting framing walls, the jaw drive cam is diametrically split into a pair of halves which are to be fastened together after being mounted in position. The split jaw drive cam is mountable and dismountable with the jaw cylinder held mounted between the framing walls. Not only is the initial assemblage of the jaw cylinder apparatus greatly facilitated in this manner, but the cam is far easier of repair or replacement than if it were of one-piece construction.

The above and other objects, features and advantages of this invention will become more apparent, and the invention itself will best be understood, from a study of the following description and appended claims, with reference had to the attached drawings showing the preferred embodiment of the invention.

DESCRIPTION OF THE PREFERRED EMBODIMENTS

General

The principles of this invention are currently believed to be best applicable to the folding mechanism of a web-fed printing press in which the printed web of paper is cut into individual sheets, and each sheet subsequently folded into a signature. The folding mechanism includes a jaw cylinder JC shown in axial section in FIG. 1 and in phantom end view in FIG. 2, and a folding cylinder FC held against the jaw cylinder as in FIG. 2. Both jaw cylinder JC and folding cylinder FC are rotatably mounted between a pair of confronting framing walls $F_a$ and $F_b$. The present invention particularly concerns the jaw cylinder JC and means more or less directly associated therewith. The jaw cylinder JC is shown to have five sets of jaws J arranged at constant circumferential spacings thereon as in FIG. 2. Each set of jaws J comprises a fixed jaw U and a movable jaw M, the latter being shown as a series of spaced-apart jaw parts. All these parts of the movable jaw M are jointly movable into and out of engagement with the fixed jaw U.

Figure 1:
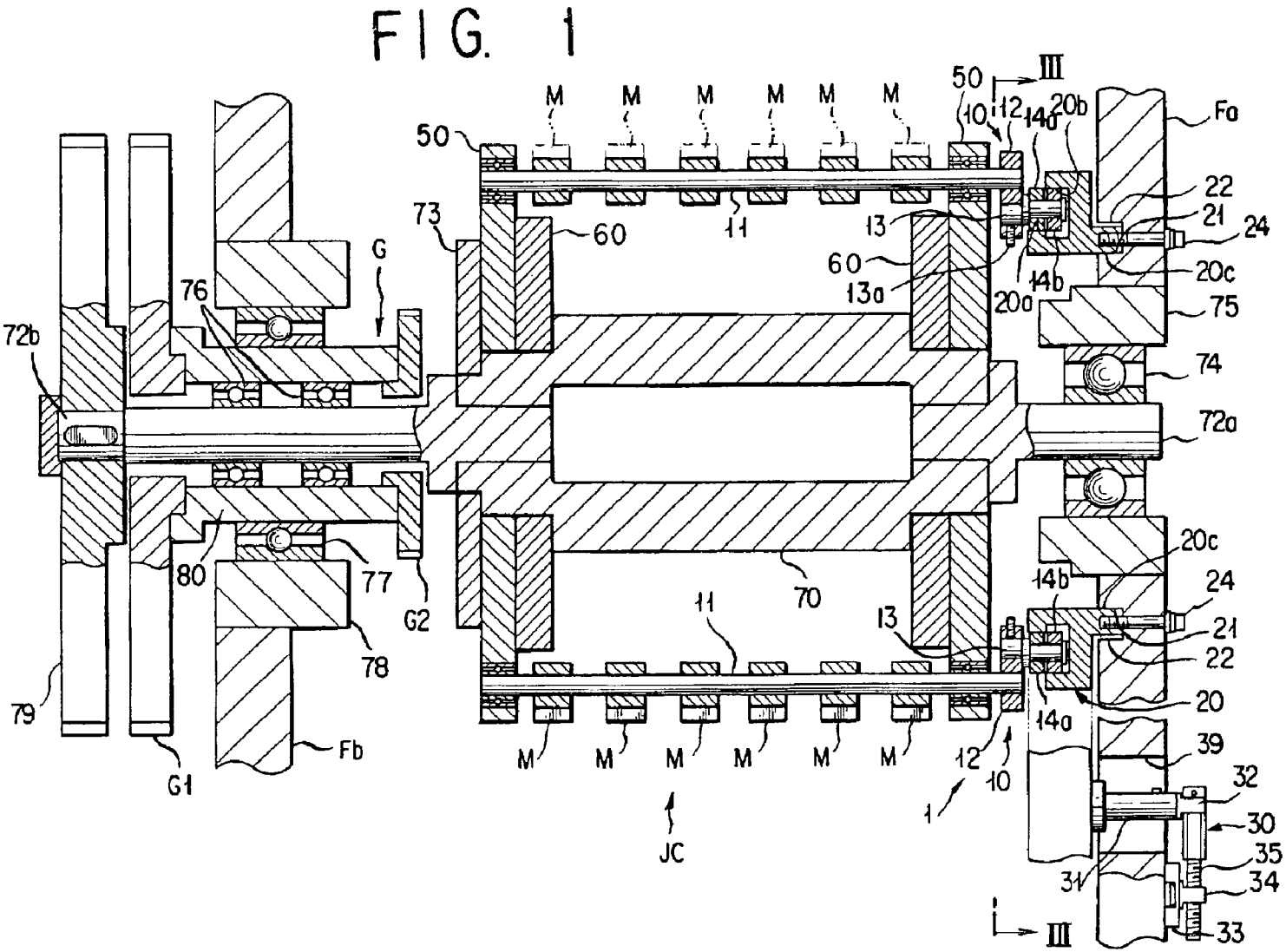
FIG. 1 is an axial section, partly shown developed, of the jaw cylinder shown together with sets of jaws and means for opening and closing the jaws in timed operational relationship to the folding cylinder which is not shown in this figure.
Figure 2:
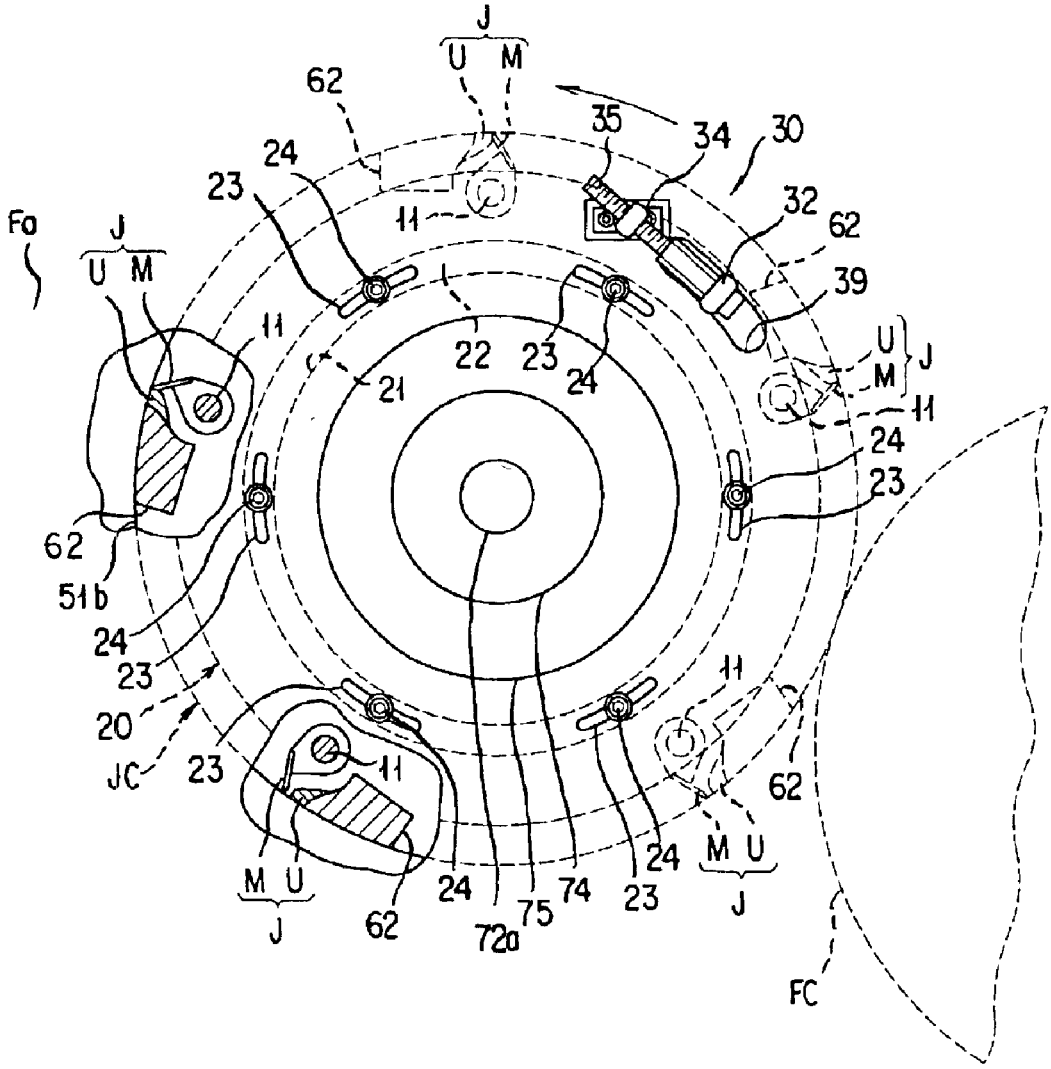
FIG. 2 is a right-hand side elevational view of the showing of FIG. 1, the view indicating in phantom outline the jaw cylinder and the sets of jaws thereon, together with part of the folding cylinder in rolling engagement with the jaw cylinder.

At 20 in FIGS. 1 and 2 is shown a jaw drive cam of annular shape mounted to the right-hand framing wall $F_a$, as viewed in FIG. 1, for angular displacement relative to the same about the axis of the jaw cylinder JC within limits. The movable jaws M of all the sets of jaws J are engaged with this jaw drive cam 20 via jaw drive cam follower means 10 seen in both FIGS. 1 and 3. The jaw drive cam 20 coacts with the cam follower means 10 to cause the movable jaws M to swing successively into and out of engagement with the associated fixed jaws U upon rotation of the jaw cylinder JC.

The angular position of the jaw drive cam 20 on the framing wall $F_a$ is capable of fine readjustment in accordance with the novel concepts of this invention in order to time the engagement of the jaw sets J to the thrust of successive printed sheets into the jaw cavities by the folding blades, not shown, on the folding cylinder FC. Employed for such fine readjustment of the angular position of the jaw drive cam 20 relative to the framing wall $F_a$, or to the jaw drive cam follower means 10, is timing means seen at 30 in FIG. 1 and illustrated on an enlarged scale in FIG. 4.

Hereinafter in this specification the above noted jaw cylinder JC, sets of jaws J, jaw drive cam 20, jaw drive cam follower means 10, and timing means 30 will be discussed in more detail, in that order and under separate headings. Comprehensive operational description, as well as a brief explanation of the method of assemblage, will follow the discussion of the listed components.

Jaw Cylinder

With reference to FIG. 1 the jaw cylinder JC has a pair of cylinder end discs 50 and a pair of inside discs 60 individually mounted on the opposite ends of a hollow core 70 in angularly displaceably relationship thereto. A retainer disc 73 is also mounted fast on one end of the core 70 to lock the cylinder end disks 50 and 60 against axial displacement. A plurality of ties 62, FIG. 2, extend between the peripheries of the pair of cylinder end disks 60 at constant circumferential spacings.

The jaw cylinder core 70 has a pair of journals $\mathbf{72}_a$ and $\mathbf{72}_b$ coaxially extending in opposite directions therefrom and rotatably supported by the pair of framing walls $F_a$ and $F_b$. The right-hand journal $\mathbf{72}_a$, as seen in FIG. 1, is received in a bearing 74 which is mounted to the framing wall $F_a$ via a bearing sleeve 75. The left-hand journal $\mathbf{72}_b$, on the other hand, is rotatably supported by bearings 76 received in a sleeve 80 which in turn is rotatably mounted to the framing wall $F_b$ via another bearing 77. The sleeve 80 constitutes a part of a conventional gap adjustment G whereby the gap between the movable and fixed jaws of each jaw set is adjustable to the thickness of the printed sheet or sheets to be caught therebetween. Projecting outwardly of the framing wall $F_b$, the journal $\mathbf{72}_b$ has a driven gear 79 nonrotatably mounted thereon. The complete jaw cylinder JC is thus gear driven for rotation relative to the pair of framing walls $F_a$ and $F_b$.

The gap adjustment G additionally comprises gears $G_1$ and $G_2$ mounted on the opposite ends of the sleeve 80 for joint rotation therewith. The gear $G_1$ is coupled to the same drive means as is the jaw cylinder JC via rotational phase changing means, not shown, for adjustably varying the angular relationship of the gear $G_1$ to the driven gear 79. The thus adjusted angular position of the gears $G_1$ and $G_2$ are transmitted to the cylinder end discs 50 and 60 in order to individually vary their angular positions on the cylinder core 70 and hence to change the gaps between the movable and fixed jaws of the jaw sets J. The gap adjustment means other than the gears $G_1$ and $G_2$ are not shown because of their impertinence to the instant invention.

Jaw Sets

FIG. 2 indicates the five sets of jaws J arranged at constant circumferential spacings on the jaw cylinder JC. Each jaw set J comprises a fixed jaw U affixed to one of the ties 62 between the pair of end plates 60 of the jaw cylinder JC, and a series of spaced-apart movable jaw parts M mounted fast to a jaw carrier shaft 11. Each jaw carrier shaft 11 has its opposite ends supported by the pair of jaw cylinder end plates 50 for bidirectional rotation relative to the same. Each series of movable jaw parts M is to pivot into and out of engagement with one associated fixed jaw U as the jaw carrier shaft 11 is driven bidirectionally from the jaw drive cam 20 via the jaw drive cam follower means 10.

Jaw Drive Cam

Figure 3:
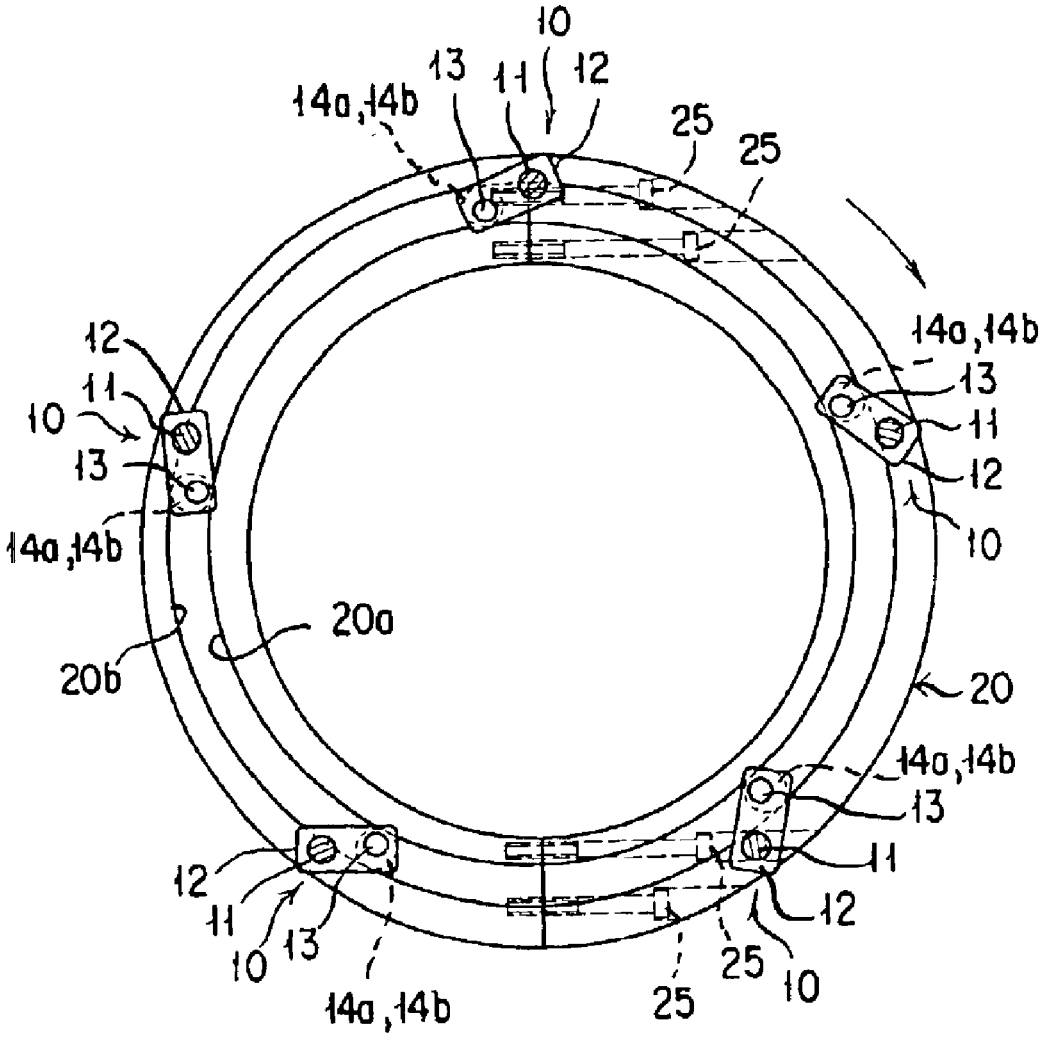
FIG. 3 is a section taken along the line III—III in FIG. 1 and showing in particular the jaw drive cam for causing the sets of jaws to open and close upon rotation of the jaw cylinder.

The jaw drive cam 20 is shown in diametric section in FIG. 1 and in elevation in FIG. 3, although it appears also in phantom outline in FIG. 2. Annular in shape, the jaw drive cam 20 is mounted to the right-hand framing wall $F_a$ by having its rim $\mathbf{20}_c$ received in an annular guide groove 22 cut in the inside surface of the framing wall. The rim $\mathbf{20}_c$ is in sliding engagement with the guide surface 21 of the groove 22 which is centered about the axis of rotation of the jaw cylinder JC.

A study of both FIGS. 1 and 2 will reveal that a plurality of, six in this particular embodiment, machine screws 24 extend with clearance through arcuate slots 23 in the framing wall $F_a$ into threaded engagement with the rim $\mathbf{20}_c$ of jaw drive cam 20. The slots 23 are of annular arrangement about the jaw cylinder axis. Thus the jaw drive cam 20 as a whole is angularly displaceable about the jaw cylinder axis in both directions within limits relative to the framing wall $F_a$ and can be locked in a desired angular position by tightening the screws 24 from outside the framing wall $F_a$.

Both FIGS. 1 and 3 indicate that the jaw drive cam 20 has two annular, concentric cam surfaces $\mathbf{20}_a$ and $\mathbf{20}_b$. Although the jaw drive cam itself is centered about the jaw cylinder axis, these cam surfaces $\mathbf{20}_a$ and $\mathbf{20}_b$ are not, in order to cause the movable jaws M of the jaw sets J to pivot toward and away from the fixed jaws U in a manner that will become apparent as the description proceeds. It will be further observed from FIG. 1 that the two cam surfaces $\mathbf{20}_a$ and $\mathbf{20}_b$ are spaced from each other not only radially but axially, too, of the jaw cylinder JC.

It is recommended for ease of assemblage and disassmblage that the jaw drive cam 20 be diametrically split into a pair of halves as in FIG. 3. The separate halves of the jaw drive cam 20 may be joined together as by a plurality of, four shown, machine screws 25 after having been positioned on the framing wall $F_a$.

Jaw Drive Cam Follower Means

The movable jaw carrier shafts 11 of all the jaw sets J are engaged with the jaw drive cam 20 via respective cam follower means seen at 10 in FIGS. 1 and 3. The cam follower means 10 comprises a crank arm 12 proximally coupled to each jaw carrier shaft 11 for joint rotation therewith, and an offset crankpin 13 coupled to the distal end of the crank arm for revolution about the axis of the jaw carrier shaft 11. The offset crankpin 13 is itself rotatable relative to the crank arm 12 about an axis parallel to the jaw carrier shaft axis and capable of being locked against rotation in any desired angular position on the crank arm by a set screw $\mathbf{13}_a$. Two cam follower rollers $\mathbf{14}_a$ and $\mathbf{14}_b$ are rotatably mounted side-by-side on the offset crankpin 13 for rolling engagement with the two concentric cam surfaces $\mathbf{20}_a$ and $\mathbf{20}_b$, respectively, of the jaw drive cam 20. Rolling over the jaw drive cam surfaces $\mathbf{20}_a$ and $\mathbf{20}_b$, the cam follower rollers $\mathbf{14}_a$ and $\mathbf{14}_b$ rotate about their common axis offset from the axis of rotation of the crankpin 13 relative to the crank arm 12.

Thus, with the rotation of the jaw cylinder JC, the cam follower rollers $\mathbf{14}_a$ and $\mathbf{14}_b$ of each cam follower means 10 will roll over the respective cam surfaces $\mathbf{20}_a$ and $\mathbf{20}_b$ of the jaw drive cam 20. Since these annular cam surfaces $\mathbf{20}_a$ and $\mathbf{20}_b$ are out of axial alignment with the jaw cylinder JC, each crank arm 12 will turn bidirectionally with one associated jaw carrier shaft 11 about the axis of the latter relative to the jaw cylinder, thereby causing the movable jaw M to pivot into and out of engagement with the fixed jaw U with each complete revolution of the jaw cylinder.

Timing Means

Figure 4:
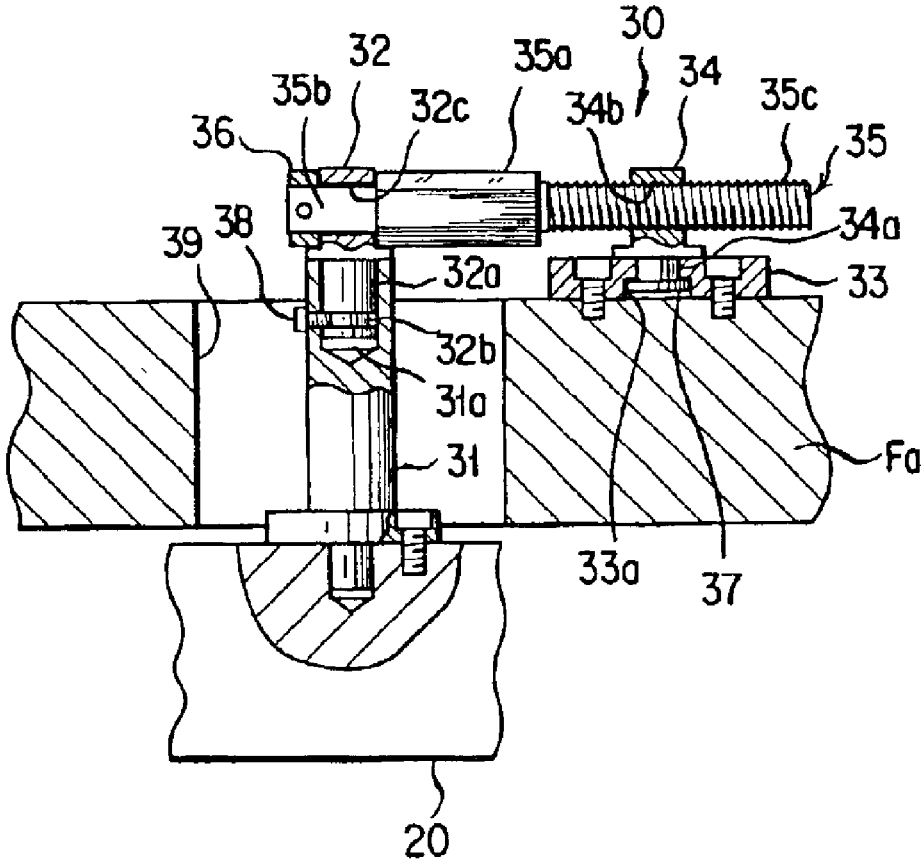
FIG. 4 is an enlarged, fragmentary sectional view, partly in elevation, of the timing means coupled to the jaw drive cam for adjustably varying its angular position relative to the jaw cylinder in order to time the operation of the sets of jaws to that of the folding blades, not shown, on the folding cylinder.

The angular position of the jaw drive cam 20 is adjustably variable along the annular guide groove 22 in the framing wall $F_a$ by the timing means seen at 30 in FIGS. 1 and 2 and on enlarged scale in FIG. 4. The framing wall $F_a$ has formed therein a slot 39 which is arched about the axis of the jaw cylinder JC. Extending through this arcuate slot 39 with substantial clearance is a pin 31 which is firmly anchored at one end to the jaw drive cam 20 and which has a bore $\mathbf{31}_a$ formed axially in its other end to receive a shank $\mathbf{32}_a$ formed in one piece with a lug 32. The shank $\mathbf{32}_a$ is rotatable relative to the pin 31 but restrained from longitudinal displacement relative to the same by a key 38 slidably received in an annular keyway $\mathbf{32}_b$ cut in the surface of the shank $\mathbf{32}_a$.

A second lug 34, similar to the first recited lug 32, is mounted on the outer surface of the framing wall $F_a$. This second lug is also formed in one piece with a shank $\mathbf{34}_a$ complete with a flange 37. The flanged shank $\mathbf{34}_a$ is rotatably received in a stepped bore $\mathbf{33}_a$ in a retainer 33, which is screwed or otherwise fastened to the framing wall $F_a$, and thereby locked against longitudinal displacement relative to the framing wall.

Thus the two lugs 32 and 34 are both rotatable about axes parallel to the axis of the jaw cylinder JC but are coupled respectively to the jaw drive cam 20 and framing wall $F_a$ against displacement along their axes of rotation. The first lug 32 has an eye or untapped hole $\mathbf{32}_c$ extending therethrough in a direction at right angles with its axis of rotation. The second lug 34 has a tapped hole $\mathbf{34}_b$ formed therethrough so as to be capable of axial alignment with the untapped hole $\mathbf{32}_c$ in the first lug 32.

Extending through the holes $\mathbf{32}_c$ and $\mathbf{34}_b$ in the lugs 32 and 34 is a lead screw 35, hereinafter referred to as the timing screw, which constitutes the primary working part of the timing means 30. The timing screw 35 is formed to include a midsection $\mathbf{35}_a$ of hexagonal cross sectional shape, a terminal section $\mathbf{35}_b$ of reduced diameter on one side of the midsection, and a screw-threaded shank $\mathbf{35}_c$ on the other side of the midsection. The reduced diameter terminal section $\mathbf{35}_b$ is rotatably received in the untapped hole $\mathbf{32}_c$ in the first lug 32 whereas the shank $\mathbf{35}_c$ extends through the tapped hole $\mathbf{34}_b$ in the second lug 34 in threaded engagement therewith. A collar 36 is formed on the end of the terminal section $\mathbf{35}_b$ of the timing screw 35 to prevent the same from disengagement out of the untapped hole $\mathbf{32}_c$ in the first lug 32.

Assemblage and Operation

The jaw drive cam 20, jaw drive cam follower means 10 and timing means 30, all constituting the features of this invention, are designed for ease of assemblage of the complete jaw cylinder apparatus, besides being well calculated to perform the primary functions for which they are intended. The jaw cylinder JC may first be assembled by mounting the pairs of end discs 50 and 60, together with the jaw sets J and gap adjustment $G_1$ to the cylinder core 70. Then the assembled jaw cylinder JC may be mounted between the pair of framing walls $F_a$ and $F_b$ in prescribed phase relationship to the folding cylinder FC.

Then the pair of halves of the jaw drive cam 20 may be positioned between jaw cylinder JC and framing wall $F_a$, by inserting their rim $\mathbf{20}_c$ into the annular guide groove 22 in the inside surface of that framing wall. Then the pair of jaw drive cam halves may be joined together by tightening the screws 25, FIG. 3. Then the jaw drive cam 20 may be fastened to the framing wall $F_a$ by the screws 24, FIGS. 1 and 2 passing through the arcuate slots 23 in the framing wall. Now has been completed the mounting of the jaw drive cam 20 to the framing wall $F_a$. Then the jaw drive cam follower means 10 may be engaged with the jaw drive cam 20 by placing the cam follower rollers $\mathbf{14}_a$ and $\mathbf{14}_b$ upon the two cam surfaces $\mathbf{20}_a$ and $\mathbf{20}_b$ of the jaw drive cam.

Next comes the step of adjusting the spacings between the movable jaws M and fixed jaws U of all the jaw sets J with respect to the angular position of the jaw cylinder JC relative to the jaw drive cam 20. All the sets of jaws J on the jaw cylinder JC may be brought one after another to the same angular position relative to the jaw drive cam 20 by turning the jaw cylinder. Then, with the offset crankpin 13 loosened from the crank arm 12, this crank arm may be turned with the jaw carrier shaft 11 to provide between the fixed and movable jaws the degree of spacing that is required in that particular angular position of the jaw set J now under consideration. Then the offset crankpin 13 may be locked against rotation relative to the crank arm 12 by tightening the set screw $\mathbf{13}_a$. The same procedure may be repeated for each jaw set J to establish the required phase relationship between the angular position of the jaw cylinder JC and the spacings between the fixed and movable jaws of all the jaw sets.

In operation the complete jaw cylinder JC, together with the jaw sets J thereon, will be set into rotation as its core 70 is driven via the gear 79, and its end discs 50 and 60 via the gears $G_1$ and $G_2$ and the unshown gap adjustment G. The cam follower rollers $\mathbf{14}_a$ and $\mathbf{14}_b$ of all the jaw sets J will roll over the two concentric surfaces $\mathbf{20}_a$ and $\mathbf{20}_b$ of the jaw drive cam 20 with such rotation of the jaw cylinder JC, causing the crank arms 12 to swing about the axes of the jaw carrier shafts 11 by virtue of the eccentricity of the jaw drive cam surfaces with respect to the jaw cylinder. With such swinging motion of the crank arms 12 the jaw carrier shafts 11 will rotate bidirectionally relative to the jaw cylinder JC. Mounted fast to the jaw carrier shafts 11, the movable jaws M of all the jaw sets J will successively pivot into and out of engagement with the fixed jaws U. Each jaw set J will close once with each complete revolution of the jaw cylinder JC to engage and fold the sheet or sheets that have been pushed off the surface of the folding cylinder FC.

It is to be appreciated that each jaw drive cam follower means 10 has two cam follower rollers $\mathbf{14}_a$ and $\mathbf{14}_b$ for engagement with the respective concentric surfaces $\mathbf{20}_a$ and $\mathbf{20}_b$ of the jaw drive cam 20. Although each cam follower roller contacts but one of the jaw drive cam surfaces $\mathbf{20}_a$ and $\mathbf{20}_b$, the crank pin 13 on which both cam follower rollers are mounted is constrained by both cam surfaces with a minimum of play, assuring the smooth, unwavering swinging of the movable jaws M into and out of engagement with the fixed jaws U.

Possibly, the swinging of the movable jaws M may not be timed precisely to the thrusting of the sheets into the jaw cavities. In that case the timing means 30, FIGS. 1, 2 and 4 may be manipulated in the following manner for readjustment of the timing. First the screws 24, FIGS. 1 and 2, may be loosened to such an extent that the jaw drive cam 20 is slidable along the annular guide groove 22 in the framing wall $F_a$. Then the timing screw 35 may be turned in a required direction by wrenching its hexagonal part $\mathbf{35}_a$. Then, by virtue of its threaded engagement with the lug 34 on the framing wall $F_a$, the timing screw 35 will travel axially with the other lug 32, which is anchored to the jaw drive cam 20 via the pin 31, thereby exerting upon the jaw drive cam a force oriented normal to the radial direction of the cam. Thereupon the jaw drive cam 20 will turn about the axis of the jaw cylinder JC by sliding along the guide groove 22 in the framing wall $F_a$. The screws 24 may all be retightened after the jaw drive cam 20 has been thus turned to the required angular position in which the pivotal motion of the movable jaws M is timed correctly to the thrusting of the sheets off the surface of the folding cylinder FC.

Notwithstanding the foregoing detailed disclosure it is not desired that the present invention be limited by the exact showing of the drawings or by the description thereof. Various modifications, alterations and adaptations of the illustrated embodiment may be resorted to in a manner limited only by a just interpretation of the claims which follow.

What is claimed is:

1. In a folding mechanism to be applied to a rotary printing press for folding printed sheets, among other applications, an adjustable-timing jaw cylinder apparatus comprising:

(a) frame means;

(b) a jaw cylinder mounted to the frame means for rotation with its own axis;

(c) a plurality of fixed jaws mounted to the jaw cylinder at circumferential spacings;

(d) a plurality of jaw carrier shafts mounted to the jaw cylinder at circumferential spacings for bidirectional rotation about their own axes relative to the jaw cylinder, the axes of the jaw carrier shafts being parallel to the axis of the jaw cylinder;

(e) a plurality of movable jaws fixedly mounted to the jaw carrier shafts for pivotal motion into and out of engagement with the respective fixed jaws with the bidirectional rotation of the jaw carrier shafts relative to the jaw cylinder;

(f) a jaw drive cam of annular shape adjustably mounted to the frame means so as to be capable of angular displacement relative to the same about the axis of the jaw cylinder and of being retained in fixed relationship to the frame means in a desired angular position relative to the jaw cylinder;

(g) jaw drive cam follower means coupled to the jaw carrier shafts and operatively engaged with the jaw drive cam for causing the movable jaws to pivot successively into and out of engagement with the respective fixed jaws upon rotation of the jaw cylinder; and (h) timing means acting between and connected to the frame means and the jaw drive cam and including a lead screw operatively mounted to the frame means to advance or retract in a rectilinear manner thereby adjustably varying the angular position of the jaw drive cam relative to the frame means about the axis of the jaw cylinder, a first connecting member coupled to the jaw drive cam, a second connecting member coupled to the frame means and having a tapped hole and the lead screw extending through the tapped hole in threaded engagement therewith and connected with the first connecting member;

(i) whereby the pivotal motion of all the movable jaws into and out of engagement with the fixed jaws can be timed to the operation of a folding cylinder which is included in the folding mechanism, by varying the angular position of the jaw drive cam relative to the frame means about the axis of the jaw cylinder by the timing means.

2. The adjustable-timing jaw cylinder apparatus of claim 1 wherein the jaw drive cam follower means comprises:

(a) a crank arm mounted to each jaw carrier shaft for joint rotation therewith; and (b) a crankpin coupled to the crank arm for joint rotation therewith about the axis of the jaw carrier shaft, the crankpin extending from the crank arm into operative engagement with the jaw drive cam.

3. The adjustable-timing jaw cylinder apparatus of claim 2 wherein the jaw drive cam is formed to include a pair of annular, concentric cam surfaces which are spaced from each other both radially and axially of the jaw cylinder, and wherein the jaw drive cam follower means further comprises two cam follower rollers mounted side-by-side to the crankpin for rotation about a common axis parallel to the axis of the jaw carrier shaft, the cam follower rollers being in rolling engagement one with each cam surface of the jaw drive cam.

4. The adjustable-timing jaw cylinder apparatus of claim 3 wherein the crankpin is offset and mounted to the crank arm for rotation relative to the same about an axis that is in parallel spaced relationship to the common axis of the cam follower rollers, and wherein the jaw cylinder apparatus further comprises means for locking the offset crankpin against rotation relative to the crank arm in a desired angular position thereon.

5. The adjustable-timing jaw cylinder apparatus of claim 1 wherein the lead screw turns manually to cause angular displacement of the jaw drive cam relative to the frame means.

6. The adjustable-timing jaw cylinder apparatus of claim 1 wherein the jaw drive cam is diametrically split into a pair of halves and wherein the jaw cylinder apparatus further comprises means for joining together the pair of halves of the jaw drive cam.

7. The adjustable-timing jaw cylinder apparatus of claim 1 wherein the lead screw has a hexagonal part positioned between the first and the second connecting members.

* * * * *